US006517293B2

(12) United States Patent
Taylor et al.

(10) Patent No.: US 6,517,293 B2
(45) Date of Patent: Feb. 11, 2003

(54) ANCHOR GRID CONNECTION ELEMENT

(76) Inventors: Thomas P. Taylor, 637 W. Hurst Blvd., Hurst, TX (US) 76053; William K. Hilfiker, 5135 Black Berry, Eureka, CA (US) 95502; James Scott Bagwell, 6717 Nantucket La., Arlington, TX (US) 76001

( * ) Notice: Subject to any disclaimer, the term of this patent is extended or adjusted under 35 U.S.C. 154(b) by 0 days.

(21) Appl. No.: 09/976,320

(22) Filed: Oct. 12, 2001

(65) Prior Publication Data

US 2002/0044840 A1 Apr. 18, 2002

Related U.S. Application Data

(60) Provisional application No. 60/240,638, filed on Oct. 16, 2000.

(51) Int. Cl.[7] ..... F16D 1/00; F16B 9/02; E02D 17/20

(52) U.S. Cl. ..... 405/302.4; 405/259.1; 405/284; 403/219; 403/333

(58) Field of Search ..... 405/284–287, 405/302.4, 302.7, 303, 259.1; 403/217, 219, 333, 410

(56) References Cited

U.S. PATENT DOCUMENTS

| | | | | |
|---|---|---|---|---|
| 4,324,508 A | | 4/1982 | Hilfiker et al. | 405/284 |
| 4,725,170 A | | 2/1988 | Davis | 405/286 |
| 4,914,876 A | | 4/1990 | Forsberg | 52/169 |
| 4,929,125 A | * | 5/1990 | Hilfiker | 405/262 |
| 4,993,879 A | * | 2/1991 | Hilfiker | 403/207 |
| 5,044,833 A | * | 9/1991 | Wilfiker | 405/262 |
| RE34,314 E | | 7/1993 | Forsberg | 52/562 |
| 5,259,704 A | | 11/1993 | Orgorchock | 405/262 |
| 5,484,235 A | | 1/1996 | Hilfiker et al. | 405/262 |
| 5,487,623 A | | 1/1996 | Anderson et al. | 405/286 |
| 5,749,680 A | | 5/1998 | Hilfiker et al. | 405/262 |
| 5,807,030 A | | 9/1998 | Anderson et al. | 405/262 |
| 6,024,516 A | * | 2/2000 | Taylor et al. | 405/262 |
| 6,050,748 A | | 4/2000 | Anderson et al. | 405/262 |
| 6,345,934 B1 | * | 2/2002 | Jailloux et al. | 405/262 |

OTHER PUBLICATIONS

Alviterra Brochure—See Ficha Tecnica, pp. 2–4 (Date Unknown).

* cited by examiner

*Primary Examiner*—Robert E. Pezzuto
*Assistant Examiner*—Tara L. Mayo
(74) *Attorney, Agent, or Firm*—Thelen Reid & Priest LLP

(57) ABSTRACT

A connection for securing the longitudinal wires of a soil-reinforcing mat to a face element for an earthen formation is provided by converging the lead ends of the wires toward one another and securing a connecting rod between the ends. The rod is extended into engagement with an anchor on the face element. A variety of structures are provided for securing the rod against separation from the anchor. To enable the mat to move in a horizontal plane relative to the face element, the rod may extend in a direction normal to the mat and be rotatably received in a vertically extending opening in the anchor.

15 Claims, 5 Drawing Sheets

ANCHOR GRID CONNECTION ELEMENT

RELATED APPLICATION

This application is based upon and claims the benefit of Provisional Application No. 60/240,638, filed Oct. 16, 2000.

BACKGROUND OF THE INVENTION

The present invention relates to a new and improved way of attaching a welded wire soil-reinforcing grid to a facing system for use in mechanically stabilized earth (MSE) retaining structures. The invention is an improvement over the prior art in that it places even stress on the tension elements, defined herein as the longitudinal wires of the soil-reinforcing grid. Further, the present invention allows a welded wire grid to translate in a horizontal plane with respect to the facing panel.

One form of art relies on attaching welded wire reinforcing grid by forming a loop or special crimp in individual longitudinal wires of the grid. The loops are formed by bending the wire 180° and welding the bent end to the longitudinal wire. This forms an integrated loop. This apparatus appears in U.S Pat. No. 4,725,170-Davis. The loop of the welded wire grid is then placed through a coiled anchor that is cast into the back of a concrete face panel. The loop of the soil reinforcing grid and anchor are in a vertical plane which is perpendicular to the back face of the panel.

In another prior art MSE system the longitudinal wire is bent 900 and attached with a plate and bolt to the back of the facing unit. In another system the longitudinal wire is crimped and joined to an anchor with a connection pin. These can be seen in U.S. Pat. Nos. 5,749,680—Hilfiker and 4,324,508—Hilfiker, respectively. The arrangement of U.S. Pat. No. 5,749,680 allows the reinforcing grids to translate in a horizontal plane with respect to the facing panels.

Other prior art places the transverse wire of the welded wire grid work behind a loop that is formed in a panel anchor. The welded wire grid is attached to the panel anchor with a connection pin. This appears in U.S. Pat. No. 5,259,704-Orgorchock.

Still other prior art bends a single longitudinal wire 180° to form a wire hairpin configuration. Welded to the paired longitudinal wires are transverse wires, which form a welded wire grid work. This combination forms an integral loop at the lead end of the soil-reinforcing element. The anchoring element protruding from the back of a panel is a formed loop. The soil-reinforcing element and loop are joined with the aid of a snap together mechanism. This can be seen in the prior art Alviterra connection shown in FIG. 1.

One block system utilizes a reinforcing element having parallel longitudinal wires with loops formed in each end. Each longitudinal wire is placed in counter bores formed in the top surface of a block. Rods are inserted through the counter bores and loops to secure the reinforcing element in the block. This arrangement, can be found in U.S. Pat. No. 5,487,623-Anderson.

A second block system utilizes a flat polymeric soil-reinforcing mat that is placed between blocks. The soil-reinforcing mat is sandwiched between the blocks. The blocks are secured together by a pin that anchors the grid. This can be seen in U.S. Pat. No. 4,914,876-Forsberg.

In U.S. Pat. No. 5,807,030-Anderson, a welded wire grid is formed with loops in each end the loops are then deflected toward one another so each loop through bore-lines up. The welded wire grid is then attached to a panel or block by passing a pin or bolt through the through-bore.

U.S. Pat. No. 6,050,748-Anderson discloses a welded wire grid in which a pair of substantially straight parallel wires are welded to a flat plate that has at least one through bore in the end nearest the MSE structure (see FIG. 55). The flat plate is then attached to the panel or block with the aid of a pin. This patent is also of interest in that FIGS. 47 to 52 disclose a connection which includes overlapping loops which are engaged between or over connecting elements embedded in the face panels.

SUMMARY OF THE INVENTION

A principal object of the present invention is to provide an apparatus and method for attaching the face of an earthen retaining structure to a soil-reinforcing element through means of a pin element attached to the reinforcing element. Attachment is achieved by extending the pin element through a connection element on the face, or into a concrete block connection element for the blocks making up the face. The pin element is attached directly to longitudinal wires of the reinforcing element and the pin is attached to a face so it is free to rotate about the connection axis. This allows the soil-reinforcing element to be skewed at an angle to the face. The connection is mechanical and does not rely on the weld shear of a transverse wire of the grid work. Further, the soil-reinforcing element can be rotated to pass obstructions. Additionally, since two longitudinal wires are utilized in lieu of one there is twice the strength available.

BRIEF DESCRIPTION OF THE INVENTION

Figure 16:
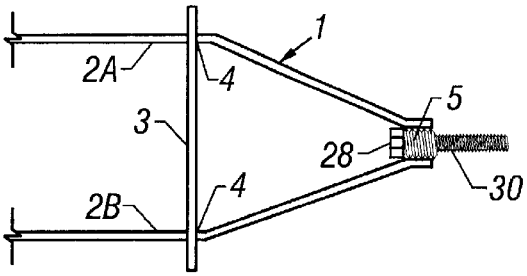
Figure 17:
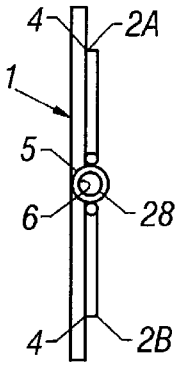
Figure 18:
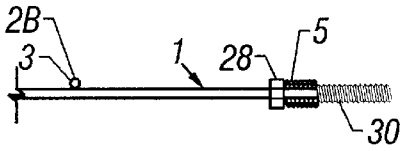
Figure 19:
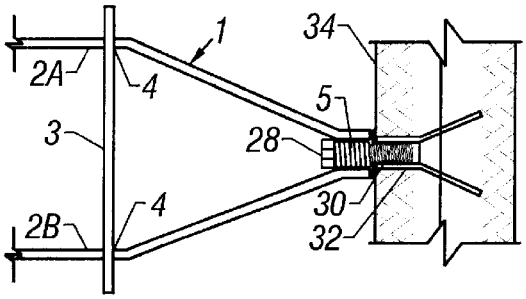
Figure 20:
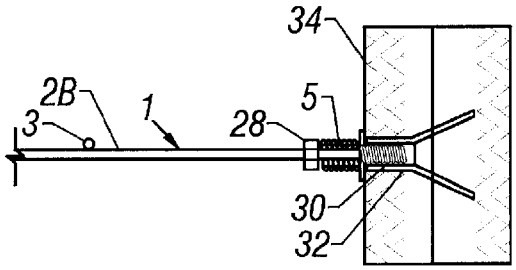
Figure 21:
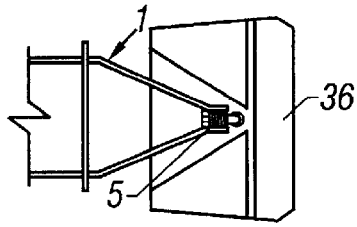
Figure 22:
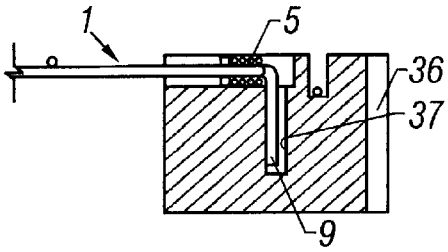
Figure 23:
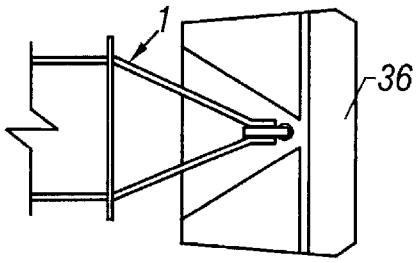
Figure 24:
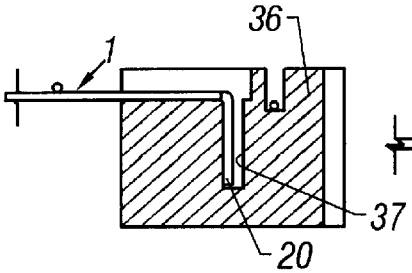
Figure 25:
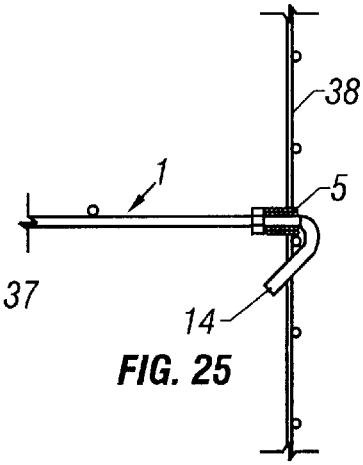
Figure 26:
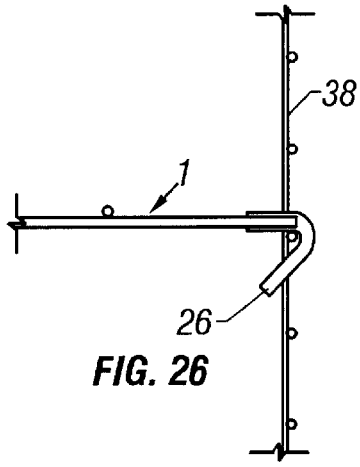

FIG. 16 top plan view of a third embodiment of the connection of the present invention;

FIG. 17 is an end elevational view of the third embodiment, turned 90° from the illustration of FIG. 16;

FIG. 18, is a side elevational view of the third embodiment connection;

FIG. 19 is a top plan view of the third embodiment connection, shown connected to a concrete face element;

FIGS. 20 is a side elevational view of the third embodiment connection, shown connected to a concrete face element;

FIGS. 21 and 22 are plan and elevational views, respectively, showing the first embodiment connection engaged in a penetration formed in a concrete block element;

FIGS. 23 and 24 are plan and elevational views showing the second embodiment connection engaged in a penetration formed in a concrete block element;

FIG. 25 is an elevational view of the modified form of the first embodiment connection, showing the hooked end of the connection engaged with a welded wire facing element; and FIG. 26 is a side elevational view showing the modified second embodiment connection with the hooked end thereof engaged with a welded wire facing element.

DESCRIPTION OF THE PREFERRED EMBODIMENTS

First Embodiment

The first embodiment of the present invention is shown in FIGS. 2 to 7 and embodies a welded wire grid 1 having a pair of longitudinal wires 2A, 2B that are substantially parallel to one another. Cross members 3 are joined to the longitudinal wires in a perpendicular fashion by a welds at their intersections 4. The lead ends of the longitudinal wires 2A, 2B are resistance welded to a coil 5. The coil is defined by a series of wires that are formed into a coil with a through-bore 6. A pin 7 is placed through the opening of the coil loop and formed with a head end 8 and bent end 9. The bent end is formed at a 90° angle relative to the body of the pin in close proximity to the end of the coil. The head end has a diameter larger than the through-bore 6 and the portion of the pin that passes through the coil. As a result, the coil 5 is captured between the head 8 and bent end 9 and the pin cannot be removed form the coil.

The bent end extends through an opening 10A in an anchor 10B cast in place within concrete face panel 11. The pin is secured against removal from the anchor 10B by parallel wire loops 12 that are cast in place in the panel 11 above and to either side of the anchor and receive a pin element 13 having a 90° bend at one end (see FIGS. 5 and 6).

Figure 1:
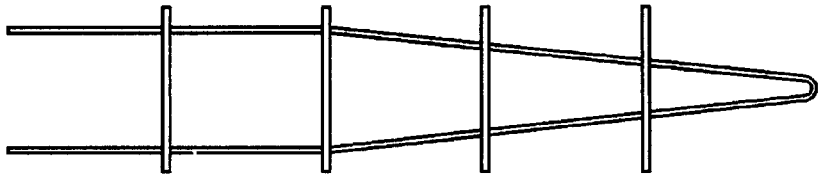
FIG. 1 (Prior Art)
FIG. 1 is a plan view showing the prior art Alviterra mat.
Figure 2:
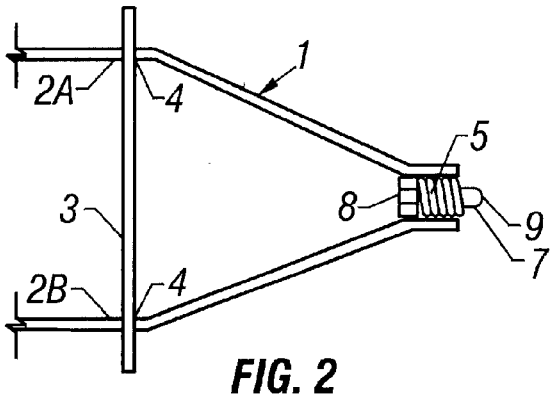
FIG. 2 is a top plan view of a first embodiment of the connection of the present invention.
Figure 3:
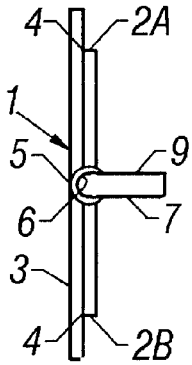
FIG. 3 is an end elevational view of the first embodiment connection, turned 90° from the illustration of FIG. 2.
Figure 4:
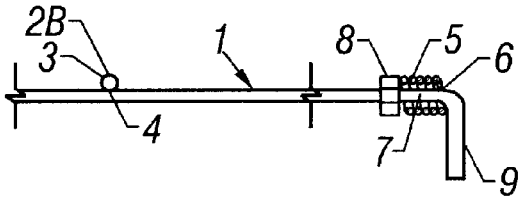
FIG. 4 is a side elevational view of the first embodiment connection.
Figure 5:
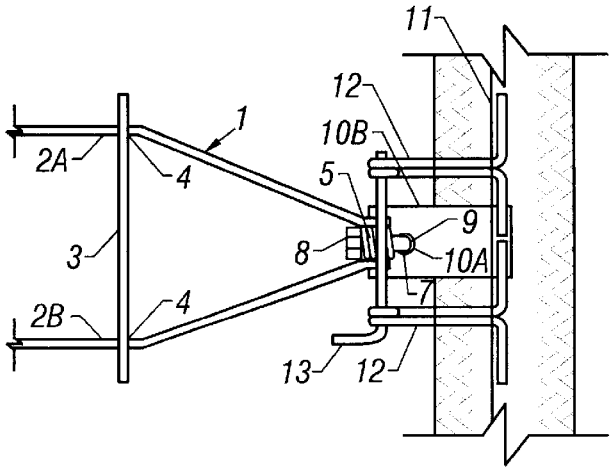
FIG. 5 is a plan view of the first embodiment connection, shown secured to a concrete face panel.
Figure 6:
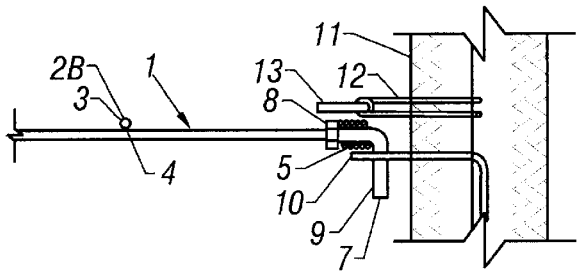
FIG. 6 is an side elevational view of first embodiment connection shown connected to a concrete face panel.
Figure 7:
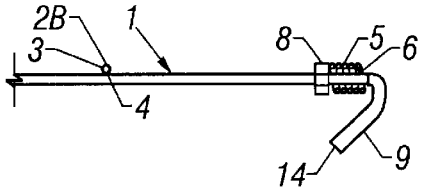
FIG. 7 is a side elevational view of a modification of the first embodiment connection, wherein the end of the connecting element is hooked.
Figure 8:
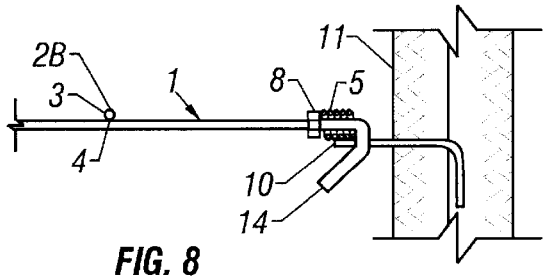
FIG. 8 is a side elevational view of the FIG. 7 modification of the first embodiment, shown connected to a concrete face panel.
Figure 9:
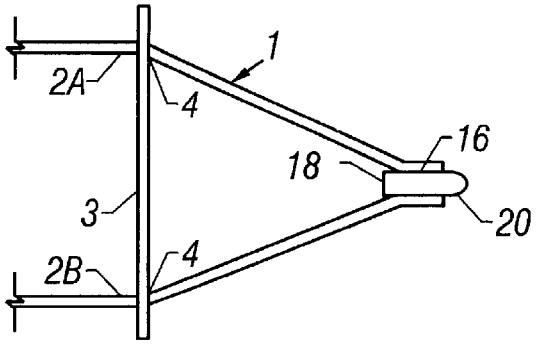
FIG. 9 is a top plan view of a second embodiment connection of the present invention.
Figure 10:
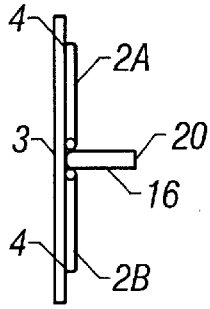
FIG. 10 is an end elevational view of the second embodiment connection, shown turned 90° from that illustrated in FIG. 9.
Figure 11:
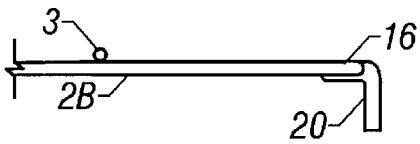
FIG. 11 is a side elevational view of the second embodiment connection.
Figure 12:
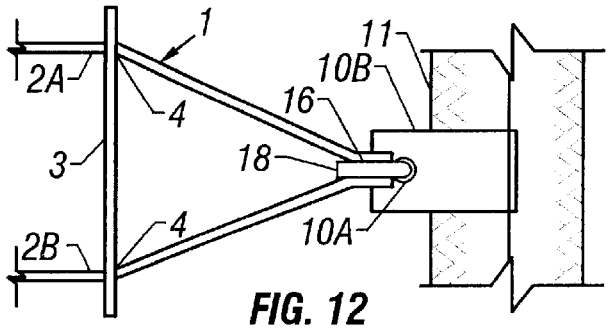
FIG. 12 is a plan view of the second embodiment connection, shown connected to a concrete face element.
Figure 13:
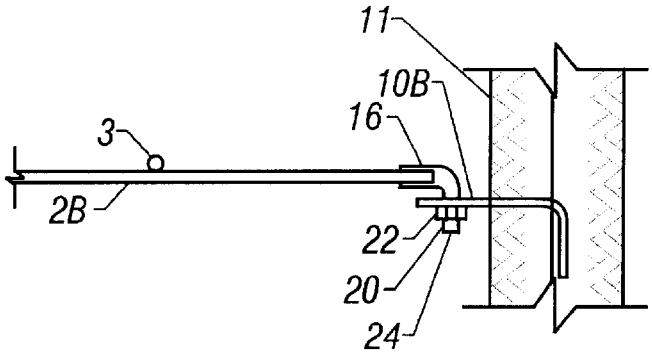
FIG. 13 is a side elevational view of the second embodiment connection, shown connected to a concrete face element.

The modified version of the first embodiment shown in FIG. 7 has the pin fabricated with a hooked end 14. The hooked end is received in the opening 10A of the anchor 10B (see FIG. 8) and avoids the need for the loops 12 and pin 13.

Second Embodiment

The second embodiment of the present invention is shown in FIGS. 9 to 15 and embodies a welded wire grid 1 having paired longitudinal wires 2A, 2B that are substantially parallel to one another. Cross members 3 are joined to the longitudinal wires in a perpendicular fashion by welds at their intersections 4. The lead ends of the longitudinal wires 2A, 2B are resistance welded to a bent rod 16. The rod has a body portion 18 to which the wires 2A, 2B are welded and bent end 20 extending laterally from the body portion. The bent end is formed by a 90° angle in close proximity to the ends of longitudinal wires 2A and 2B.

The bent end 20 extends through the opening 10A of an anchor 10B embedded in a concrete face panel 11 to secure the grid 1 to the face panel. The bent end is secured against removal from the anchor 10B by a nut 22 threadably received on the distal end 24 of the bent end (see FIG. 13).

Figure 14:
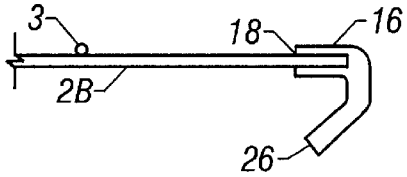
FIG. 14 is a side elevational view of a modified version of the second embodiment connection, wherein the end of the connecting element is hooked.
Figure 15:
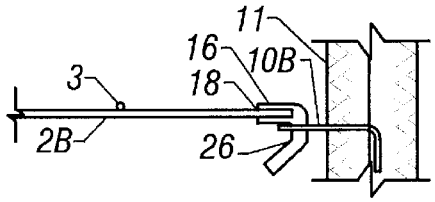
FIG. 15 is a side elevational view of the modified second embodiment connector of FIG. 14, shown connected to a concrete face element.

The modified version of the second embodiment shown in FIG. 14 has the bent rod 16 fabricated with a hooked end 26. The hooked end is received in opening 10A of the anchor 10B (see FIG. 15) and avoids the need for the nut 22.

Third Embodiment

The third embodiment of the present invention is shown in FIGS. 16 to 20 and embodies a welded wire grid 1 having paired longitudinal wires 2A, 2B that are substantially parallel to one another. Cross members 3 are joined to the longitudinal wires in a perpendicular fashion by a welds at their intersections 4. The lead ends of the longitudinal wires 2A, 2B are resistance welded to a coil 5. The coil is defined by a series of wires that are formed into a coil with a through-bore 6.

A bolt 28 with a threaded end 30 is placed through the opening of the coil 5. The bolt is then screwed into a ferrule insert 32 that is cast into a concrete panel 34 (see FIGS. 19 and 20).

USE OF THE CONNECTION

The first and second embodiment connections can be used with panels or with concrete elements that have depressions formed in their top surface and a circular penetration or bore to accept the pin element. FIGS. 21 and 22 show the first embodiment engaged in a concrete block 36 so formed. FIGS. 23 and 24 show the second embodiment engaged in a corresponding block 36. The penetration or bore is designated 37.

The first and second embodiments with the modified hooked end could be used with a wire-facing element. FIG. 25 shows the first embodiment in such a usage, with the wire facing element being designated 34. FIG. 26 shows the second embodiment with the modified hooked end engaged in a corresponding wire facing element 34.

While specific embodiments have been illustrated and described, it should be understood that the invention is not limited to these embodiments, but rather is defined by the accompanying claims.

What we claim:

1. In combination with a welded wire soil reinforcing mat having a pair of adjacent longitudinal wires for extension into a formation to be reinforced and a face element for disposition at the face of the formation; an improved connection for securing the mat to the face element, comprising:

a) extended portions of said longitudinal wires converging toward one another and terminating distally in portions adjacent one another;

b) a horizontally positioned connection element having a body portion disposed between and integrally joined to the adjacent portions and an end extending from the adjacent portions;

c) an anchor disposed on said face element, said anchor having an opening receiving the end of the connection element; and, d) means securing the end of the connection element against separation from the opening.

2. In a combination according to claim 1, the improved connection wherein:

a) the end extends in a direction generally normal to the longitudinal wires;

b) the opening in the anchor is disposed generally vertically and the end extends through the opening for rotation relative to the anchor about a generally vertical axis; and, c) the means securing the end against separation from the opening comprises an element carried by the face element and extending over the connection element for engagement therewith to prevent the end from being displaced from the opening.

3. In a combination according to claim 1, the improved connection wherein:

a) the end extends in a direction generally normal to the longitudinal wires;

b) the opening in the anchor is disposed generally vertically and the end extends through the opening for rotation relative to the anchor about a generally vertical axis;

c) the means securing the end against separation from the opening comprises a nut threadably engaged with a distal portion of the end for engagement beneath the anchor.

4. In a combination according to claim 1, the improved connection wherein:

a) the face element comprises a concrete member;

b) the anchor is integrally formed in the concrete member; and c) the opening comprises a bore disposed generally vertically in the concrete member.

5. In combination with a welded wire soil reinforcing mat having a pair of adjacent longitudinal wires for extension into a formation to be reinforced and a face element for disposition at the face of the formation; an improved connection for securing the mat to the face element, comprising:

a) extended portions of said longitudinal wires converging toward one another and terminating distally in portions adjacent one another;

b) a connecting rod secured between said portions, said rod having an end extending from said portions;

c) an anchor disposed on said face element, said anchor having an opening receiving the end of the connecting rod;

d) means securing the end against separation from the opening; and wherein:

i. the end extends in a direction generally normal to the longitudinal wires;

ii. the opening in the anchor is disposed generally vertically and the end extends through the opening for rotation relative to the anchor about a generally vertical axis; and iii. the means securing the end against separation from the opening comprises a hooked portion on the end disposed for engagement beneath the anchor.

6. In combination with a welded wire soil reinforcing mat having a pair of adjacent longitudinal wires for extension into a formation to be reinforced and a face element for disposition at the face of the formation; an improved connection for securing the mat to the face element, comprising:

a) extended portions of said longitudinal wires converging toward one another and terminating distally in portions adjacent one another;

b) a connecting rod secured between said portions, said rod having an end extending from said portions;

c) an anchor disposed on said face element, said anchor having an opening receiving the end of the connecting rod;

d) means securing the end against separation from the opening; and wherein:

i. a coil is welded between the portions, said coil having an open passage extending therethrough; and ii. the connecting rod extends through the passage.

7. In a combination according to claim 6, the improved connection wherein the connecting rod is threadably engaged with the passage of the coil.

8. In a combination according to claim 6, the improved connection wherein the connecting rod extends slidably through the passage and is formed at one end with a head disposed in abutting engagement with one end of the coil and the end of the connecting rod extends from an end of the coil opposite said one end.

9. In a combination according to claim 6, wherein:

a) the longitudinal wires are disposed in a generally horizontal plane;

b) the passage through the coil is disposed in the generally horizontal plane; and c) the end of the connecting rod extends at generally a right angle to the horizontal plane.

10. In combination with a welded wire soil reinforcing mat having a pair of adjacent longitudinal wires for extension into a formation to be reinforced and a face element for disposition at the face of the formation; an improved connection for securing the mat to the face element, comprising:

a) extended portions of said longitudinal wires converging toward one another and terminating distally in portions adjacent one another;

b) a connecting rod secured between said portions, said rod having an end extending from said portions;

c) an anchor disposed on said face element, said anchor having an opening receiving the end of the connecting rod;

d) means securing the end against separation from the opening; and wherein:

i. the face element comprises a concrete member;

ii. the anchor comprises a recess integrally formed in an upper surface of the concrete member;

iii. the opening comprises a bore disposed generally vertically in the concrete member and extending downwardly from the recess; and iv. the means securing the end against separation from the opening comprises a member overlying the recess.

11. In combination with a welded wire soil reinforcing mat having a pair of adjacent longitudinal wires for extension into a formation to be reinforced and a welded wire face element for disposition at the face of the formation, an improved connection for securing the mat to the face element, comprising:

a) extended portions of said longitudinal wires converging toward one another and terminating distally in portions adjacent one another;

b) a connecting rod secured between said portions, said rod having an end extending from said portions; and c) a hook formed on the end and engaged over a wire of the face element for rotation relative thereto about a generally vertical axis.

12. In combination with a welded wire soil reinforcing mat having a pair of adjacent longitudinal wires for extension into a formation to be reinforced and a face element for disposition at the face of the formation; an improved method for securing the mat to the face element, comprising:

a) extending portions of said longitudinal wires into converging relationship with one another;

b) integrally securing a connection element between said portions so that said connection element is fixed between the converging portions and has a distal end extending from the portions; and c) extending said distal end into secure engagement with the face element.

13. In combination with a welded wire soil reinforcing mat having a pair of adjacent longitudinal wires for extension into a formation to be reinforced and a face element for disposition at the face of the formation; an improved method for securing the mat to the face element, comprising:

a) extending portions of said longitudinal wires into converging relationship with one another;

b) securing a rod between said portions so that an end of the rod extends laterally from the portions;

c) securing said end to the face element; and wherein:

i. the longitudinal wires are disposed in a generally horizontal plane;

ii. the end extends generally vertically; and iii. the end is secured to the face element by extending the end into pivotal engagement with a generally vertically disposed passage provided on the face element.

14. In combination with a welded wire soil reinforcing mat having a pair of adjacent longitudinal wires for extension into a formation to be reinforced and a face element for disposition at the face of the formation; an improved method for securing the mat to the face element, comprising:

a) extending portions of said longitudinal wires into converging relationship with one another;

b) securing a rod between said portions so that an end of the rod extends laterally from the portions;

c) securing said end to the face element; and wherein:

i. the face element comprises a welded wire grid; and ii. the rod is secured to the face element by forming the end of the rod into a hook and engaging the hook over a wire of the grid.

15. In combination with a welded wire soil reinforcing mat having a pair of adjacent longitudinal wires for extension into a formation to be reinforced and a face element for disposition at the face of the formation; an improved method for securing the mat to the face element, comprising:

a) extending portions of said longitudinal wires into converging relationship with one another;

b) securing a rod between said portions so that an end of the rod extends laterally from the portions;

c) securing said end to the face element; and wherein:

i. the end extends in a generally vertical direction;

ii. the face element comprises a concrete member; and iii. the rod is secured to the face element by forming a vertical bore in the face element and extending the end into engagement with the bore for free rotation about a generally vertical axis.

* * * * *